United States Patent [19]

Robinson et al.

[11] 4,286,527

[45] Sep. 1, 1981

[54] SYSTEM FOR ASH REMOVAL

[75] Inventors: Storm D. Robinson, Vernon; Douglas M. Rode, Newington, both of Conn.

[73] Assignee: Combustion Engineering, Inc., Windsor, Conn.

[21] Appl. No.: 101,653

[22] Filed: Dec. 10, 1979

[51] Int. Cl.[3] ..... F23J 1/02

[52] U.S. Cl. ..... 110/165 A; 110/171; 406/94; 406/137

[58] Field of Search ..... 110/165 R, 165 A, 168, 110/169, 171, 255, 258, 259; 406/94, 137

[56] References Cited

U.S. PATENT DOCUMENTS

| | | | |
|---|---|---|---|
| 1,809,501 | 6/1931 | Allen | 110/171 |
| 1,957,583 | 5/1934 | Foresman | 110/171 |
| 2,280,944 | 4/1942 | Foresman | 406/137 |
| 2,339,216 | 1/1944 | Allardice | 110/171 |
| 2,344,347 | 3/1944 | Foresman | 110/171 |
| 2,421,977 | 6/1947 | Allen | 110/165 A |
| 2,589,836 | 3/1952 | Martin | 110/165 R |
| 3,314,679 | 4/1967 | Kolln | 406/94 |
| 3,993,359 | 11/1976 | Sweeney | 406/137 |
| 4,213,402 | 7/1980 | Kochey | 110/171 |

FOREIGN PATENT DOCUMENTS

| | | | |
|---|---|---|---|
| 1959070 | 5/1971 | Fed. Rep. of Germany | 110/165 R |

*Primary Examiner*—Henry C. Yuen
*Attorney, Agent, or Firm*—Arthur L. Wade

[57] ABSTRACT

In the back-pass of a steam generator, hot fly ash collects at a station. At the station to which the ash gravitates, a liquid bath is provided to receive the ash. Nozzles are arranged within the liquid receiving the ash to urge the material into a mechanical grinder in which the ash is reduced for ultimate disposal.

3 Claims, 4 Drawing Figures

SYSTEM FOR ASH REMOVAL

TECHNICAL FIELD

The present invention relates to the liquid purging of plate surfaces in the back-pass of steam generating boilers upon which sintering fly ash collects. The invention further relates to directing purging liquid over the surfaces upon which the fly ash collects to force the ash to a single collection position where the size of the ash may be mechanically reduced prior to ultimate disposal.

BACKGROUND ART

Various fuels burned in the utility boiler produce residue. This residue collects on the walls of the chamber in which the combustion takes place. There is an ongoing problem of removing this solid residue of combustion. The burning of pulverized coal as a fuel leaves the largest amounts of solid residue behind for disposal.

In addition to the problem of removing solid residue from the bottom of the combustion chamber, there is the problem of the fly ash carried over into the back-pass to which the combustion chamber discharges. The temperature of the combustion gases is reduced as they flow into heat exchange contact with structures mounted in the back-pass. The temperature of the combustion gases, typically within the 1000° F. to 1200° F. range, may reduce to the range including 800° F. after initial contact with the economizer mounted in the back-pass. The fly ash sinters within this temperature range and gravitates into impact upon surfaces of the back-pass which change the direction of the combustion gas flow. As the fly ash sinters into an enlarging body, it may actually become an obstruction to the flow of combustion gases in the back-pass.

The problem addressed by the present invention is continuous removal of the collected fly ash from the 800° F. environment. A mechanism must be applied to continuously quench the fly ash and periodically remove the collected fly ash. Preferably, liquid is to be applied as an agent to purge the plate surface upon which the fly ash collects.

DISCLOSURE OF THE INVENTION

The present invention provides a liquid surface arranged in the back-pass. The surface has fly ash directed to impinge upon it. The fly ash gravitates and is collected before being purged to a specific location for disposal. The purging liquid is directed under pressure to force the fly ash toward a specific location. The concept includes a mechanical grinding mechanism at the location to receive the fly ash and reduce its size to facilitate its transportation toward a point of ultimate disposal.

Other objects, advantages and features of the invention will become apparent to one skilled in the art upon consideration of the written specifications, appended claims and accompanying drawings.

BEST MODE FOR CARRYING OUT THE INVENTION

The present invention was brought into existence by the problem of ash disposal from the products of combustion discharged from furnaces. The term "furnace" is used in a broad sense. A steam generator is a particular form of furnace. The common denominator of all forms of furnaces is found in a combustion chamber where coal, oil or gas is burned as a source of heat. The heat, whether in the form of radiation and/or convection, is passed through the walls of pipes to elevate the temperature of fluids flowing through the pipes.

The solid residue of the combustion process may largely collect upon the walls of the combustion chamber and present a problem of removal. Additionally, solid particulate from the combustion process is carried along with the combustion gases.

The solid particulate entrained by the hot gases flowed from the furnace will be referred to as fly ash. The conduit from the furnace, carrying this mixture of combustion gases and fly ash, will be termed the "back-pass". As the back-pass changes direction, the fly ash will collect or drop out at the bottom of the direction change. The ash may sinter, due to the high temperature, and eventually obstruct the back-pass to the flow of combustion gases therethrough.

Figure 1:
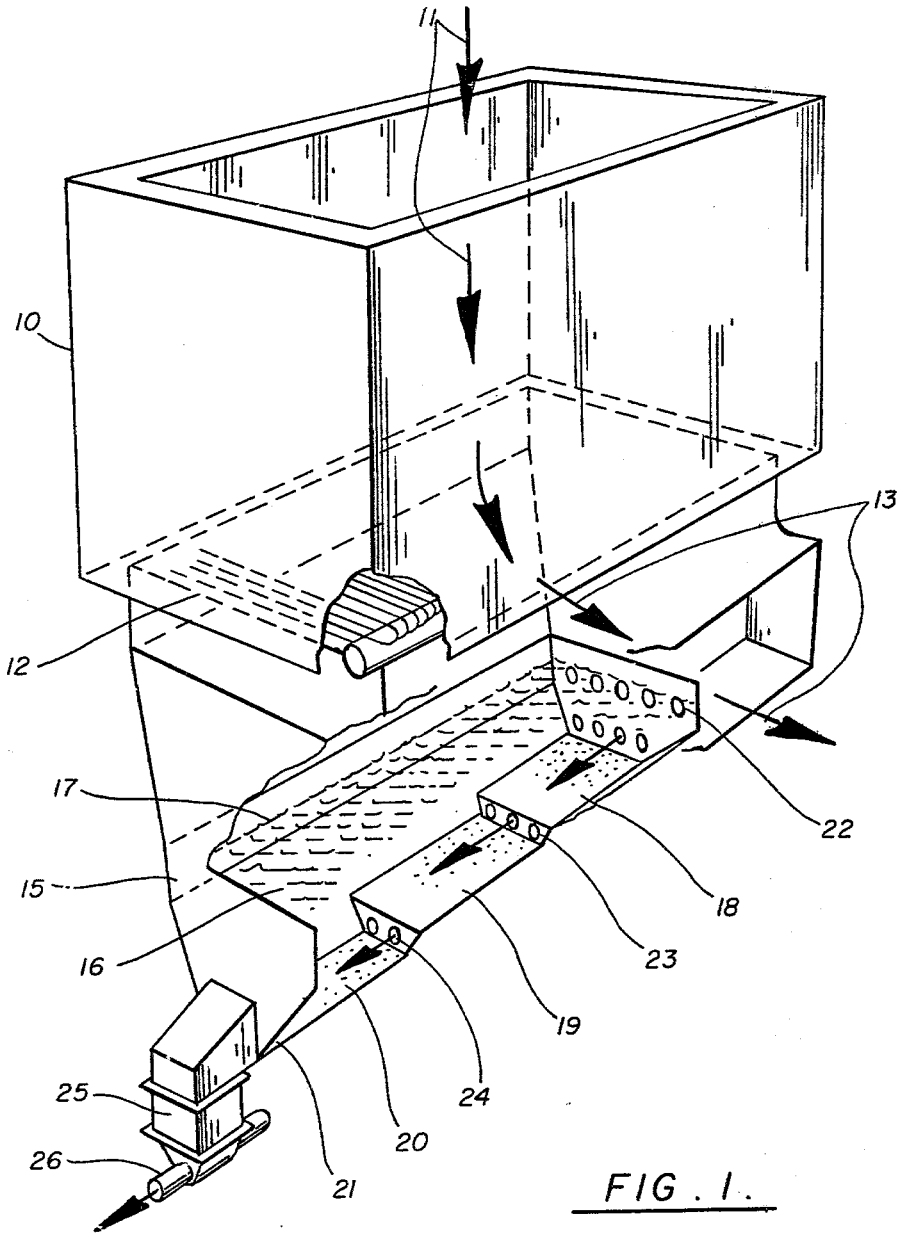
FIG. 1 is a perspective of the section of the back-pass of a steam generator in which an impingement surface is arranged for fly ash and having a system of fluid purging embodied in the present invention.

In FIG. 1, the back-pass from the furnace is disclosed at 10. This back-pass is seen as being square or rectangular in cross-section. This conduit is depicted to extend vertically downward. The combustion gases are indicated as flowing downwardly in the direction indicated by arrows 11.

As is customary, an economizer section of pipes 12 spans the cross-sectional area of the conduit. So positioned, the economizer 12 is heated by the convective heat of the combustion gases flowing downwardly through the conduit. As a matter of interest, the temperature of these gases is in the order of 1200° F. prior to their contact with economizer 12. Their temperature will reduce to the order of 800° F. after passing through the economizer 12. The fly ash entrained in the combustion gases passes through the economizer structure and readily collects upon those surfaces immediately following the economizer structure 12 which effects the change of the direction of the flow of gases.

Some of the fly ash may collect upon and adhere to tubes of the economizer 12. The surfaces of these tubes present a problem not considered by this disclosure, but solved by soot blowing. Whatever solid particulate or fly ash passes through the economizer structure presents the problem addressed by the present invention.

Below the economizer structure 12, back-pass 10 usually changes direction sharply. This sharp change in direction of the combustion gases is indicated by the arrows 13 which are continuations of the arrows 11. It has been customary to provide a dry receptable, or hopper, at this bend in the back-pass for the collection of the fly ash thrown by centrifugal force as the combustion gases are caused to deviate from their vertical downward direction. It has been a continual problem to remove the collection of fly ash which tends to sinter into large masses upon this surface of conduit 10. This fly ash may accumulate to form such a large body of sintered material that its obstruction to following combustion gases becomes a serious problem.

The present invention substitutes a structure for the dry collection surface of the prior art. The substituted structure is indicated to a large extent in FIG. 1 and in durther detail in FIG. 2.

Essentially, the present invention provides a receptacle 15 in which a body of liquid 16, preferably water, is impounded to present a surface 17 which will collect the fly ash. It can be readily discerned from the drawings that the fly ash is thrown into the body of fluid 16. Fly ash has its temperature reduced by the liquid-water and as a solid material settles through the water to the bottom of receptacle 15. Surface 17 of the body of water 16 can be regarded as the impingement surface for the fly ash. On the other hand, the water body 16 can be regarded as receiving the fly ash as solid material thrown into the body of water. In both events, the solid particulate is expected to gravitate to the bottom of receptacle 15.

Figure 2:
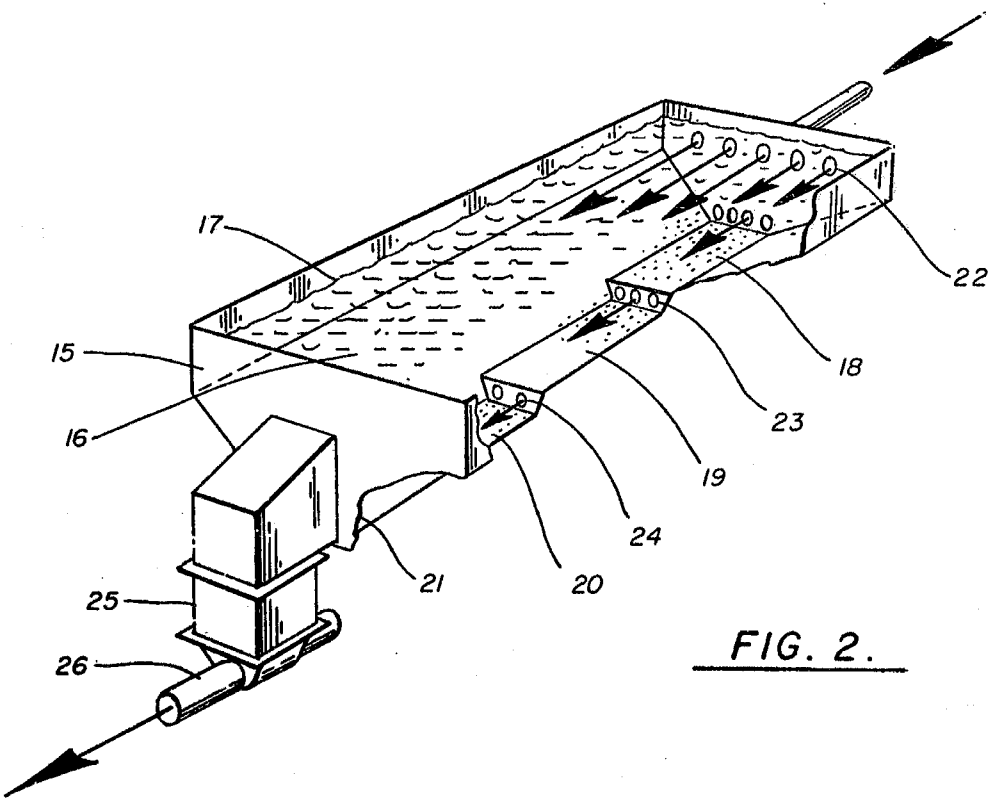
FIG. 2 is an enlargement of the lower portion of FIG. 1.

In FIGS. 1 and 2, the bottom of the receptacle 15 is formed into a series of steps 18, 19 and 20. The bottom is not limited to the three steps disclosed. The three steps 18, 19 and 20 simply represent a plurality of such structures leading down to a position 21 from which the fly ash is allowed to exit the receptacle.

Presumably, the fly ash thrown into the body of water 16 will gravitate to all the steps comprising the bottom of the receptacle 15. A set of nozzles is mounted above each step to direct purging jets of water over the surface of the steps. Nozzle set 22 directs water over the horizontal surface of step 18; nozzle set 23 directs water over step 19; and nozzle set 24 directs water over step 20. No specific size, pattern, or number of nozzles limits the invention. The invention is embodied in the arrangement whereby these nozzles flush, scour, or purge the solid material on the steps toward position 21 which is the lowest position on the floor of structure 15.

Rather than attempting to convey the fluid across a single floor surface of receptacle 15, the floor is broken up into steps or stages in order to make separate purging of each step possible within the capabilities of moving the liquid a horizontal distance with the pressure available. A single exit could be provided at position 21 through which the mixture of water and particulate would be directed to an ultimate disposal point. To provide for the requirement of reducing the size of this particular material, a mechanjical grinder 25 is provided into which all the fly ash particulate is carried from position 21. In grinding 25, the fly ash is ground to a desired size and the mixture of ground ash and water is taken by conduit 26 to an ultimate disposal destination.

Figure 3:
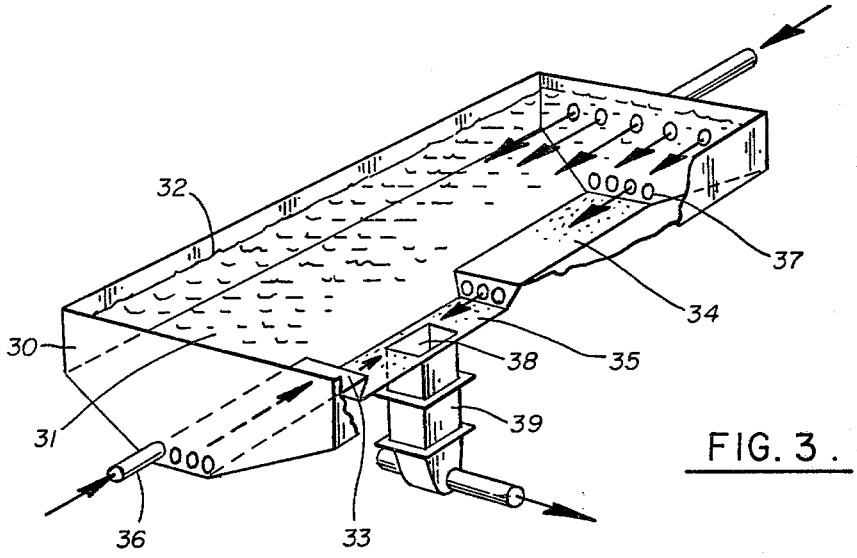
FIG. 3 is an alternate arrangement of purging structure similar to that of FIGS. 1 and 2.
Figure 4:
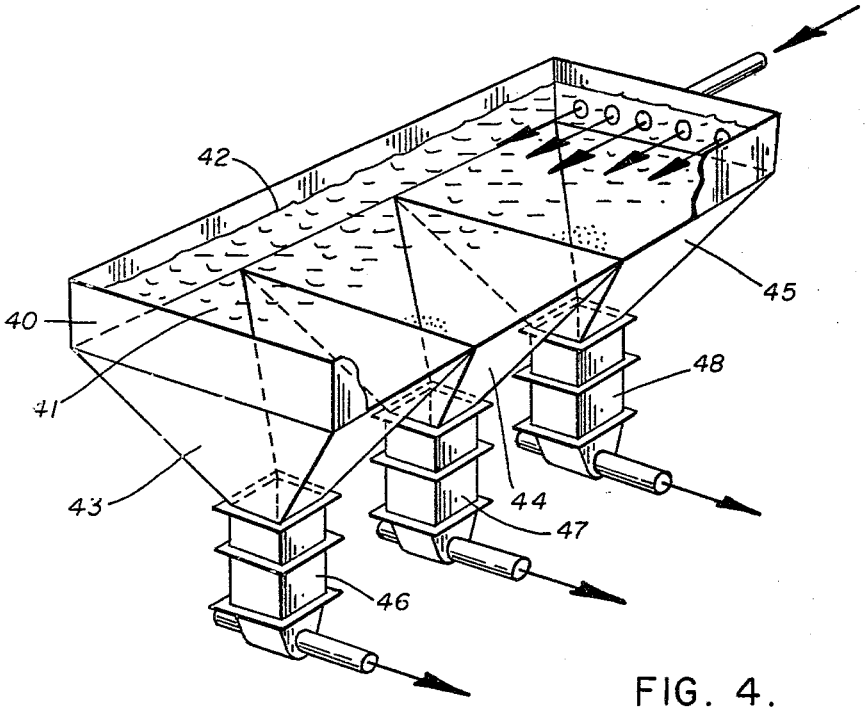
FIG. 4 is an alternate arrangement to those arrangements disclosed in FIGS. 1, 2 and 3.

FIGS. 3 and 4 disclose arrangements alternate to that of FIGS. 1 and 2 and also embody the present invention. In FIG. 3, receptacle 30 is sized and arranged to substitute for receptacle 15 of FIGS. 1 and 2. Receptacle 30 impounds water body 31 with surface 32 upon which the fly ash collects as entrained combustion gases are diverted in their direction of flow.

A bottom, or floor, for receptacle 30 has a series of steps 33, 34, 35. However, step 35 is centralized between steps 33 and 34 to form the final, lower, position to which the fly ash is forced. Nozzles 36 are disclosed as directing water jets across surface 33 while nozzles 37 direct similar jets of water across surface 34. Other nozzles may be positioned, as required, to force the fly ash on all the surfaces toward central opening 38.

The fly ash and water flowing through open 38 may be passed to an ultimate disposal point. Additional, grinder 39 may be provided to receive the fly ash forced to this position. The grinder 39 can then reduce the size of the fly ash to that required for reach movement through a pipe to an ultimate disposal point.

FIG. 4 discloses still another arrangement for eady disposal of fly ash under the concepts of this invention. In FIG. 4, receptacle 40 impounds water body 41 to provide a surface 42. The bottom of receptacle 40 is disclosed as a plurality of hoppers 43, 44, 45. As disclosed, the conical sides of these hoppers may readily guide the fly ash received into the fluid body 41 toward grinders 46, 47, 48. Therefore, if the plurality of grinders and hoppers can be accepted, it may be possible to eliminate the need for water nozzles to additionally provide force for promoting the movement of fly ash into the grinders. Of course, the use of additional water-jetting nozzles is not precluded from this embodiment. Any and all forces provided by the invention can be used to move the fly ash to its ultimate disposal.

We claim:

1. A back-pass section of a furnace burning solid fuel which produces fly ash carried into the back-pass by entraining heating gases as products of the combustion, including, a section of back-pass from a furnace including a first downwardly directed portion and a second portion connected to the first portion at substantially a right angle, a receptacle positioned below the gas descending in the first portion of the back-pass, a body of liquid impounded by the receptacle having a surface receiving fly ash from combustion gases flowing from the first back-pass portion into the second back-pass portion as the entraining gases are diverted in their downward path from the first portion into a second path within the second portion, a series of step surfaces beneath the surface of the body of liquid receiving fly ash gravitated through the body of liquid, an exit from the receptacle located at the lowest of the step surfaces, a nozzle for each step surface arranged to direct liquid supplied to the nozzle over its step surface in removing ash from the step surface to the exit at the lowest of the step surfaces, a supply of liquid for each of the nozzles, and a conduit connected to the exit through which fly ash is continuously removed.

2. The back-pass section of claim 1, in which, the liquid impounded by the receptacle and supplied the nozzles is water.

3. The back-pass section of claim 1, in which, a mechanical grinder is mounted in the conduit to receive the fly ash and reduce the fly ash to a predetermined size for flowing to an ultimate point of disposal.

* * * * *